US005237795A

United States Patent [19]

Cheney et al.

[11] Patent Number: 5,237,795

[45] Date of Patent: Aug. 24, 1993

[54] PACKAGING SYSTEM

[75] Inventors: Ervin J. Cheney, St. Louis Park; Peter N. Y. Pan, Minnetonka; Gregory M. Fulkerson, Maple Plain, all of Minn.

[73] Assignee: Thiele Engineering Company, Minneapolis, Minn.

[21] Appl. No.: 756,308

[22] Filed: Sep. 6, 1991

[51] Int. Cl.[5] ..... B65B 5/10; B65B 35/30; B65B 35/54

[52] U.S. Cl. ..... 53/154; 53/251; 53/534; 53/543; 53/566

[58] Field of Search ..... 53/154, 251, 534, 543, 53/566, 48.1

[56] References Cited

U.S. PATENT DOCUMENTS 2,756,553 7/1956 Ferguson et al. .
2,828,595 4/1958 Talbot et al. ..... 53/251
2,974,454 3/1961 Andre et al. .
3,037,431 6/1962 McGihon .
3,225,510 12/1965 Jones et al. ..... 53/566 X
3,300,947 1/1967 Fahrenbach ..... 53/566 X
3,332,199 7/1967 Wong .
3,778,959 12/1973 Langen et al. ..... 53/534 X
3,848,394 11/1974 Heisler ..... 53/566 X
4,237,673 12/1980 Calvert et al. .
4,875,323 10/1989 Craighead ..... 53/566 X
4,887,414 12/1989 Arena ..... 53/543

*Primary Examiner*—John Sipos
*Assistant Examiner*—Linda B. Johnson
*Attorney, Agent, or Firm*—Hugh D. Jaeger

[57] ABSTRACT

A high speed multiple conveyor packaging system having product separating bars that separate a product into specific sized groups on moving opposing conveyors. Two product streams diverge to meet the separating bars, and subsequently reconverge after separation for loading into a carton or package. Separated conveyed product is channeled from opposing conveyors into another conveyed product carton from opposing carton ends. A tight package is formed by sets of formed guide bars which cause the package flaps to be stretched or formed to the position of maximum tightness about the product.

2 Claims, 14 Drawing Sheets

PACKAGING SYSTEM

BACKGROUND OF THE INVENTION

1. Field of the Invention—This invention relates to equipment for loading multiple product units into a sleeve-type package. In particularly, the invention relates to machines for loading cans or bottles or similar cylindrical geometric objects into cartons.

2. Description of the Prior Art—A multitude of apparatus has been used for loading packages with sets of individual product. In particular, the techniques for loading cardboard sleeve-type packages with cans or bottles are manifold.

Cans of beverage are commonly sold in cardboard 12-packs or 24-can cases. The package is a cardboard sleeve into which the cans or bottles are slid from the end. The ends of the sleeve are then folded and glued to seal the individual products in place.

The present invention relates to conveyor belt loaders for such cardboard containers. There is a wealth of patent art in this area, as well as prior art machines which have not been disclosed in patents. The common thread through these disclosures is a central conveyor with transverse bars which separate the open sleeved containers, and hold them as the conveyor moves. Separate side conveyors for feeding cans into the sleeves come in from an angle on either side of the central conveyor. The cans are urged into the container sleeve as the conveyors converge. Two main tasks that must be accomplished are sorting of cans on the side conveyors into sets for loading, and the actual loading of the cans into the sleeves.

The teachings of the prior art are in two main sets.

The first set of prior art involves devices that separate the cans on the outer conveyor with means extending inwardly from the outer side of the apparatus. Some prime examples of this type of structure are U.S. Pat. No. 3,332,199 to Wong, issued Jul. 20, 1967, U.S. Pat. No. 3,300,947 to Fahrenbach, issued Jan. 31, 1967, and U.S. Pat. No. 3,037,431 to McGihon, issued Jun. 5, 1962. Other such art is illustrated by U.S. Pat. No. 2,974,454 to Andre et al., issued Mar. 14, 1961, and U.S. Pat. No. 3,778,959 to Langen, et al., issued Dec. 18, 1973.

In this first class of prior art Various types of fingers or extensions come inwardly from the outside of the device to separate the product, such as cans, into sets. This is done as a first step before the cans are fed into containers on the central conveyor. For example, in the McGihon patent there is a disk with projections which mark off sets of cans. As the disk rotates, a set of cans, for example three in the McGihon disclosure, is isolated between the pairs of fingers. This set then travels down the conveyor into the sleeve.

In the Fahrenbach disclosure, there is a belt having projections which isolate cans. A belt-driven wheel then has a pair of fingers which divide the cans into sets in a manner somewhat similar to McGihon. After separation, the sets of cans are urged into the containers by the merging of the conveyors.

The Wong patent also has a belt bearing fingers which separates sets of cans. The cans are urged into the sleeve by the action of the conveyor merging with the central conveyor.

All of these side-actuated devices have their benefits and their failings. One problem with such side separation of the cans using these prior art techniques is that it was necessarily slow. The complex mechanical arrangement of belts, gears, and projecting fingers had too many moving parts to operate in a rapid manner. It is desirable for today's can loaders to operate in a range of 1,800 to 2,400 cans per minute. Such rapid movement of cans into sleeves cannot be accomplished with these complex belt and finger systems.

A second class of prior art devices involves separator bars or flight bars on the central conveyor which preform a dual task. These bars both 1) hold the sleeved container on the central conveyor, and 2) separate the cans into sets. One example of such dual function flight bar or metering bar is the Thiele Suntan lotion machine, which was commercially available in 1972. This early Thiele machine was shown to have speeded up the process by having a simple mechanism. The flight bar had wedge shaped ends which entered the stream of product as the conveyors merged and thereby metered the product. The flight bars also urged the product into the sleeves which were held by the flight bars.

A second example of this combined technique is U.S. Pat. No. 4,237,673 to Calvert et al., issued Dec. 9, 1980, which operates in the same manner as the Thiele suntan lotion machine. As in the early Thiele machine, the Calvert structure uses dual-purpose central metering bars with wedged shaped tips which preform the dual functions of separating the cans as they come down a diagonal conveyor and also of holding the container sleeves on the central conveyor.

The dual purpose metering bar has prove to be a successful device for years, but it does not allow speeds sufficient to satisfy today's demands.

What is needed in order to speed up loading to meet today's production standards is a can loader which separates the functions of isolating sets of cans for loading and for holding the container sleeves, without using the complex belt, sprocket and finger techniques of the prior art.

SUMMARY OF THE INVENTION

A package loader constructed according to the present invention includes a central conveyor for carrying multiple container sleeves and at least one side conveyor mounted to meet the central conveyor at an acute angle for directing a stream of product carried by the side conveyor into the sleeved containers. The loader includes a separator bar conveyor mounted generally outboard from and generally parallel to the side conveyor. The separator conveyor carries separator bars which extend into the stream of product on the side conveyor for separating product into sets for later loading into sleeves.

The apparatus preferably has two side conveyors which run generally parallel at a first end of the apparatus, then diverge outboard of a first end of the central conveyor. The side conveyors later reconverge to meet two sides of the central conveyor. The separator conveyor preferably involves first and second conveyors having separator bars continually moving along the separator conveyor. As the side conveyors, bearing a stream of product, diverge, the stream comes in contact with the inwardly projecting separator bars. The separator bars are inserted through the stream as the stream diverges outward to meet the separator bars. After the side conveyors reconverge, the separator bars come free of the stream of containers which is entering the package, and follow the separator conveyor under the product stream and go back to the first end to restart the cycle.

The multiple conveyor scheme of the present invention allow for extremely fast carton loading. The separator bar conveyors have very few moving parts and no complex equipment is needed to separate the product into sets. The present invention overcomes the problems of slower speed in the prior art. By separating the function of can separation from carton holding, the present invention accelerates the process. The bottle neck of the dual function central flight bar is avoided. The present invention also avoids the complex belt and sprocket schemes of the prior art.

One significant aspect and feature of the present invention is that a missing or downed can in any set of cans can be sensed prior to the set of cans or objects being loaded into the carton.

Another significant aspect and feature of the present invention is to provide for a tight and secure package about the objects, such as cans. The package provides that all of the objects, such as cans, are aligned with respect to each other.

Having thus described the embodiments of the present invention, it is a principal object hereof to provide a packaging system for packaging of objects, such as cans, into a predetermined pattern, load the objects into a carton in the pattern, and secure the flaps to secure the objects in the carton with respect to each other.

BRIEF DESCRIPTION OF THE DRAWINGS

Other objects of the present invention and many of the attendant advantages of the present invention will be readily appreciated as the same becomes better understood by reference to the following detailed description when considered in connection with the accompanying drawings, in which like reference numerals designate like parts throughout the figures thereof and wherein.

DESCRIPTION OF THE PREFERRED EMBODIMENTS

Figure 1:
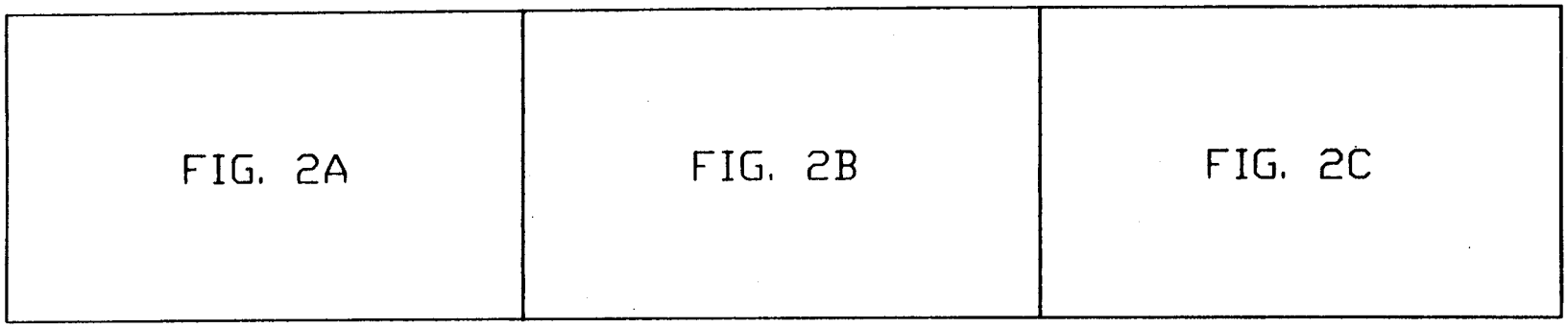
FIG. 1 illustrates the alignment of FIGS. 2A, 2B, and 2C.
Figure 2A:
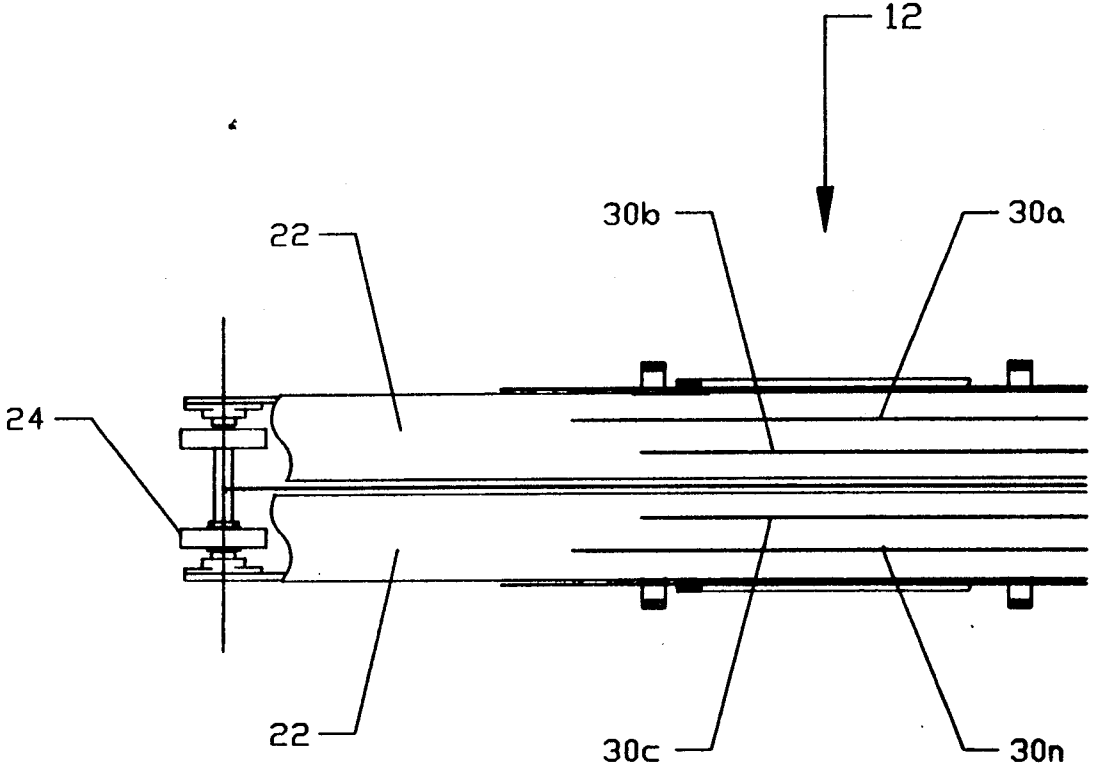
FIGS. 2A, 2B, and 2C illustrate a top plan view of a package loader constructed according to the present invention.
Figure 2B:
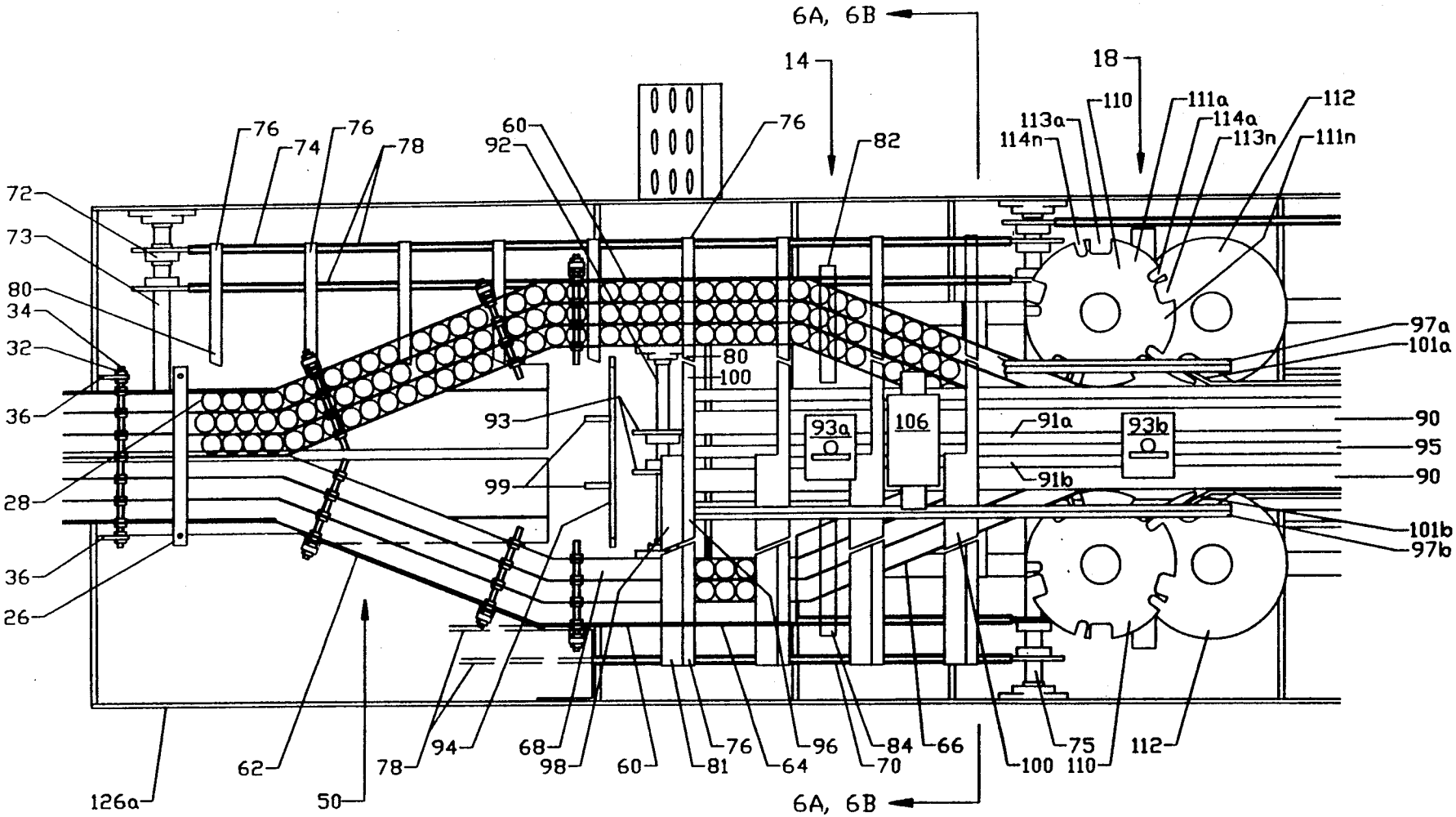
Figure 2C:
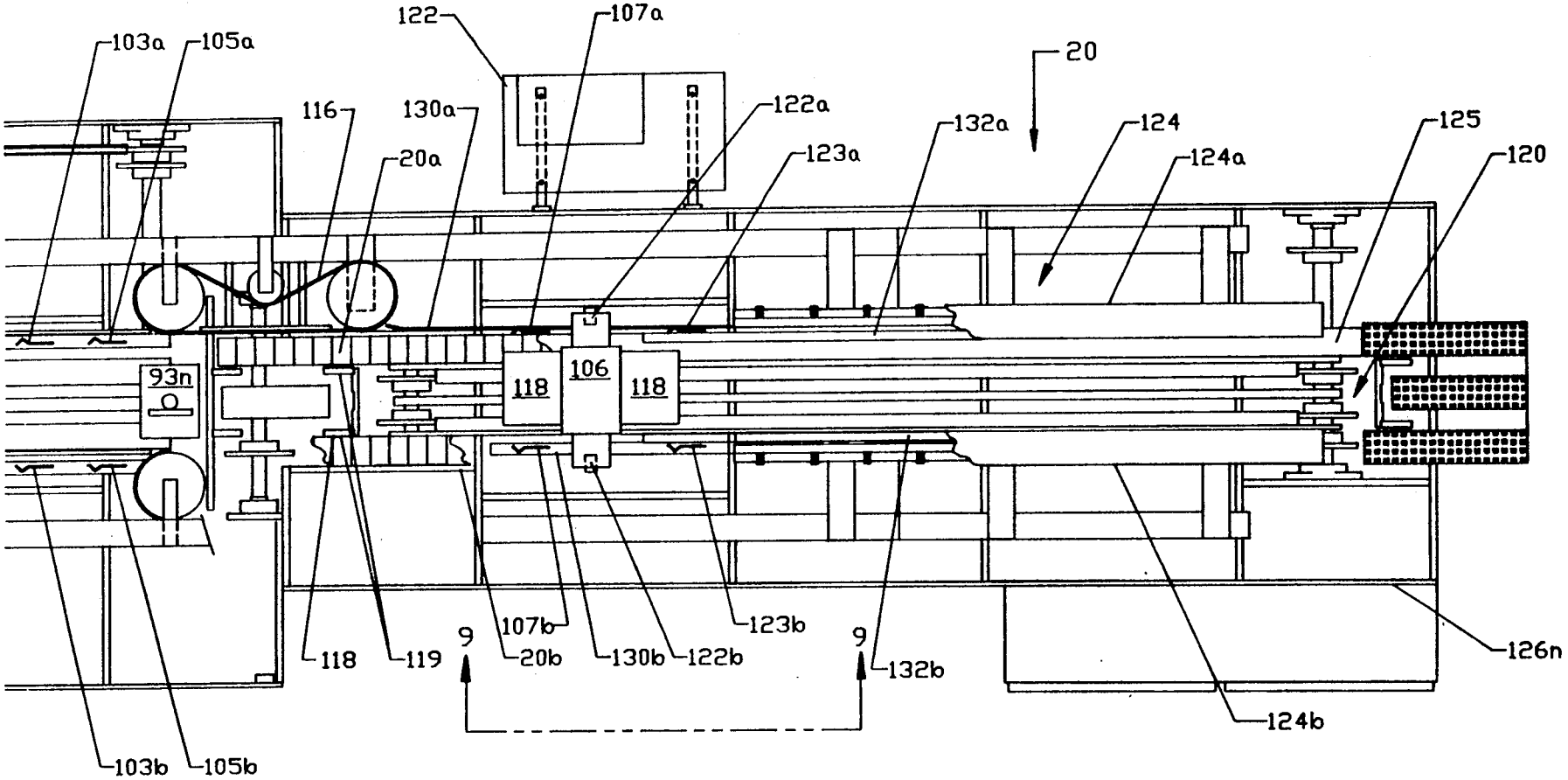

FIG. 1 illustrates the alignment of FIGS. 2A, 2B and 2C.

Figure 4A:
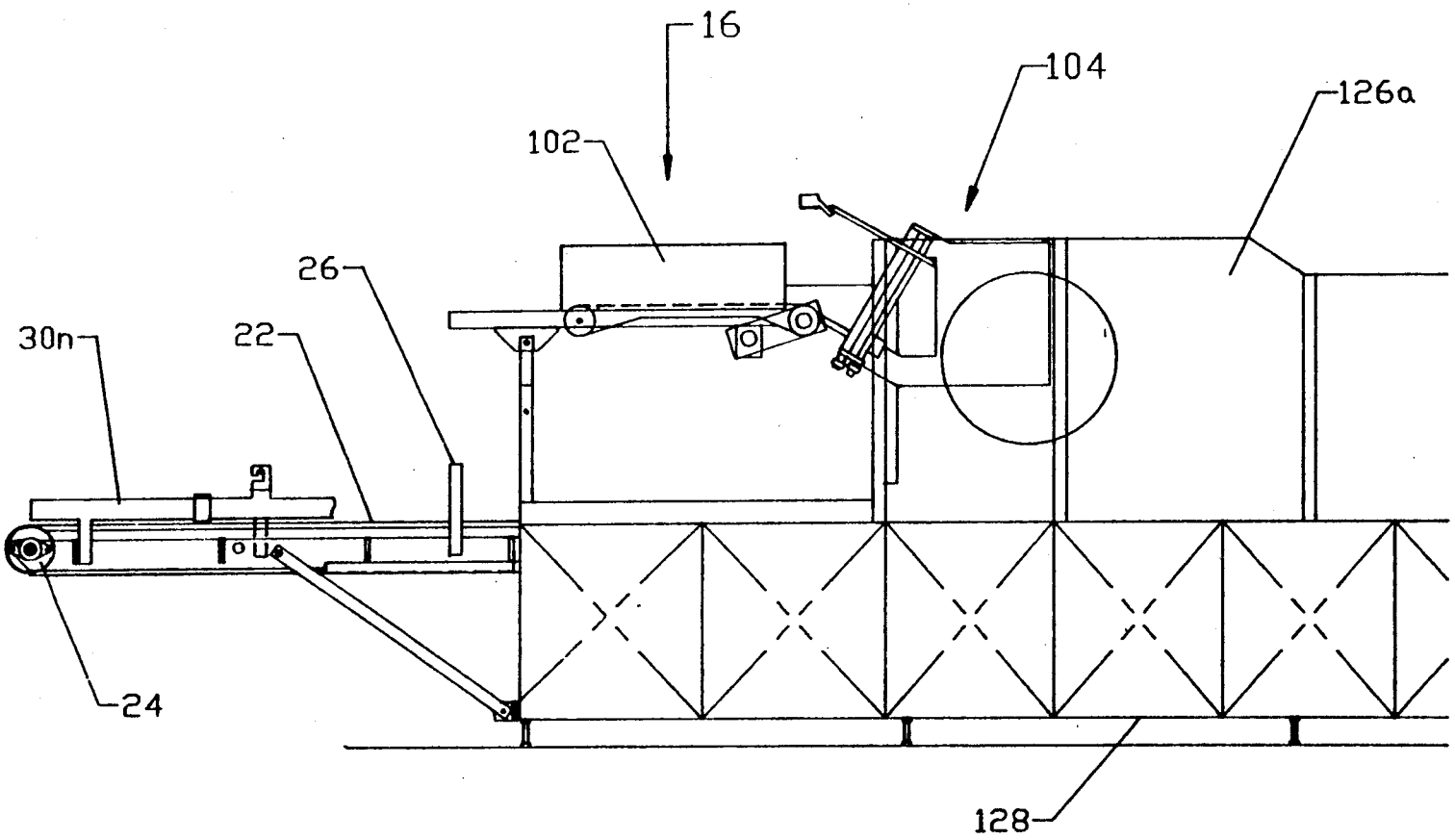
FIGS. 4A and 4B illustrate a side plan view of the loader of FIGS. 2A-2C.
Figure 4B:
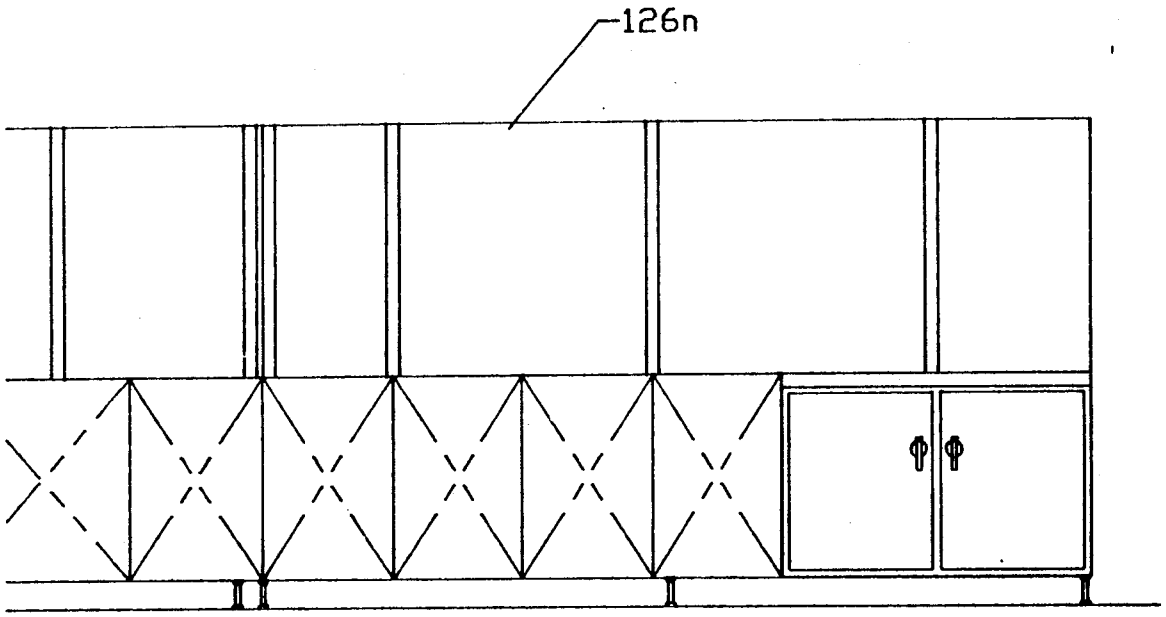

FIGS. 2A, 2B, and 2C illustrate a top plan view of the package loader 10 including an in-feed section 12, product packing section 14, carton assembly section 16 of FIGS. 4A-4B, carton gluing section 18, and outflow conveyor section 20.

In-feed section 12 includes in-feed conveyor 22 which is moved by a drive system 24, and a product sensor 26.

The in-feed conveyor 22 is preferably constructed to 7.5" wide Rexnord brand tabletop chains driven by a 1 horsepower drive motor and a one-way clutch. Product 28 is transferred to the in-feed conveyor 22 by any type of prior art equipment desired by the user.

Guide rails **30*a*-30*n* are mounted over an in-feed conveyor 22 to separate product 28** into the number of desired lanes. For example, when filling 24-pack cases of cans, six lanes are used; when filling 12-packs of cans, four lanes are used. While the present invention is described in terms of a device for inserting cans into containers, the apparatus may be used by one skilled in the art by various other types of product.

Guide rails **30*a*-30*n* are suspended from supports 32, which include a threaded rod 34 mounted on side members 36. Guide rails 30*a*-30*n* are affixed to the threaded rod 34** and separated by nuts mounted on the threads.

Figure 7:
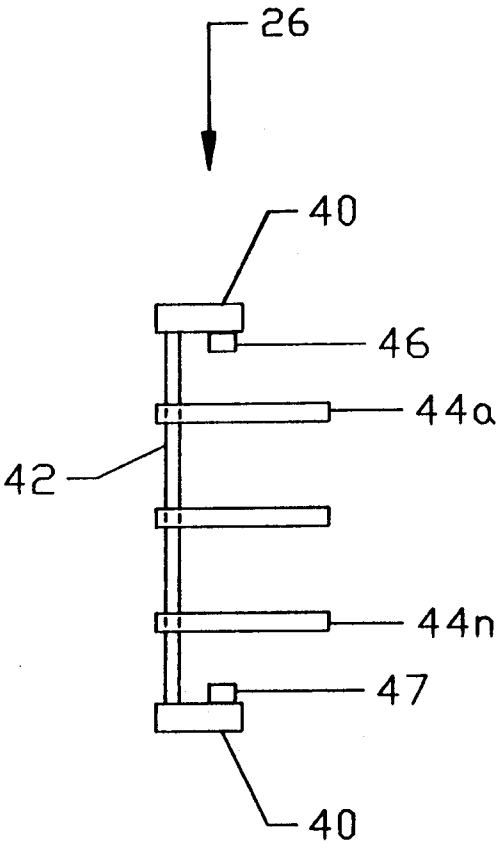
FIG. 7 illustrates a top plan view of the can sensor of FIGS. 2A-2C enlarged.
Figure 8:
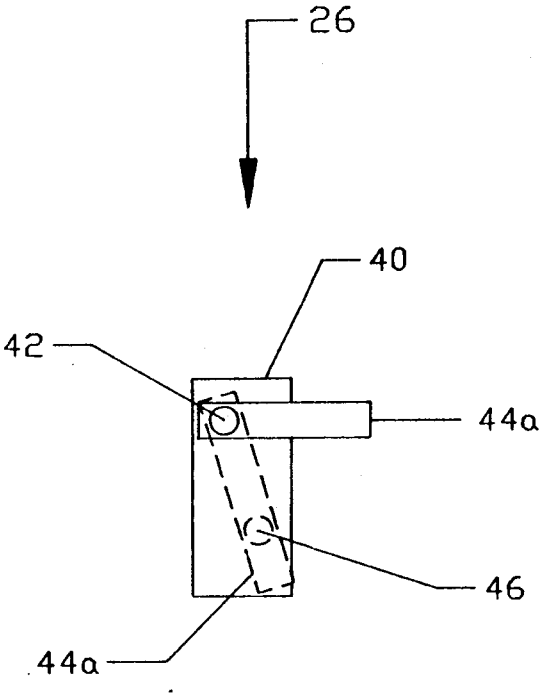
FIG. 8 illustrates a side view of the can sensor of FIG. 7.

A product sensor 26 best illustrated in FIGS. 7 and 8, determines if product is missing from the stream or is dislodged from proper position. A pair of side supports 40 support a rod 42 extending transversely across in-feed conveyor 22. A plurality of nylon detection fingers **44*a*-44*n* are mounted in a rotatable manner on rod 42**. There is preferably one detection finger for each lane in the apparatus.

A photo-eye transmitter 46 transmits normally to a photo-eye receiver 47 when the product 28 is in its proper position. The top of the product 28 holds fingers **44*a*-44*n* in an elevated position. When no product 28 is present, one or more of the fingers 44*a*-44*n* falls to the position such as shown in dotted lines in FIG. 8, blocking photo-eye transmitter 46 transmission to the photo-eye receiver 47**. This would happen if there is a can missing on the conveyor, or the can has fallen down.

When photo-eye receiver 47 senses product error, it signals the system control that there is a product error. Photo-eye transmitter 46 and photo-eye receiver 47 are electronically connected to the system under control so that all detected errors are transmitted to allow the system controller to signal the users to take corrective action.

Guide rails **30*a*-30*n* begin to angle outwardly in area 50 at preferably a 22° angle, or any other suitable angle, with respect to in-feed conveyor 22. Guide rails 30*a*-30*n* in angled area 50 begin to separate the flow of product 28 into two diverging streams near the inboard end of in-feed conveyor 22**.

A pair of mirror-image stationary guide decks 60 on either side of package loader 10 move product 28 from in-feed conveyor 22 further along the system. Each guide deck 60 includes a first angled section 62, straight section 64 and second inwardly angled section 66. First angled section 62 is designed to mate at the preferable 22° angle, or any other suitable angle, against the side of in-feed conveyor 22 so that lane area 68 of guide deck 60 aligns with lanes of product guided by corresponding guide rails **30*a*-30*n* of in-feed section 12. Therefore, product 28 moves down in-feed conveyor 22, is guided at an angle in angled area 50 of guide rails 30*a*-30*n*, and then is slid off in-feed conveyor 22 onto the fixed lane area 68 of guide deck 60 by the guide rails 30*a*-30*n*. Product 28 continues to flow through the guide deck 60 by the force of flow of successive product 28 coming off of in-feed conveyor 22. In other words, in-feed conveyor 22 is an active conveyor, whereas guide deck 60** is a passive conveyor where cans are only moved by the pressure of the product stream.

First and second separator bar conveyors 70 are mounted on opposite sides of package loader 10 outboard from in-feed conveyor 22 and guide deck 60. The conveyors 70 has a drive system 72, including a drive shaft 73 and another shaft 75, which moves sets of bar mounts 74 through a range from area 50 where guide rails 30*a*–30*n* start to diverge from conveyor 22 up to a point where product 28 is loaded.

Each pair of separator bar mounts 74 carries a separator bar 76. The separator bars 76 are constructed of hard core aluminum and are mounted to the separator bar mounts 74 which in turn are mounted to two chains 78 which are moved by drive system 72. Separator bars 76 have an angled inner end 80.

As product 28 is moving generally from left to right in FIGS. 2A–2C, mirror image chains 78 are also moving separator bars 76 in a parallel path at generally the same speed. As shown in the Figures, separator bars 76 extend inwardly from chains 78. At the beginning of separator bar conveyor 70, separator bars are in free air spaced apart from the stream of product 28. As the separator bars 76 and product 28 move down the system, guide rails 30*a*–30*n* begin to guide product 28 outwardly at a 22° angle. This is continued as guide deck 60 picks up product 28 and continues its outward diverging path. As the stream of product 28 diverges outwardly, the angled edge 80 of the separator bar 76 is inserted in product stream between successive product 28.

Separator bars 76 are spaced on separator bar conveyor 70 to divide product 28 into sets as it progresses down guide deck 60. In the example illustrated, product 28 is divided into sets of 12. This means that 12 units of product 28 will be inserted into the container from each side, making a 24-container case. In this manner, product 28 is divided into sets with a minimum of moving parts in separator bar conveyor 70. No complex finger mechanism is needed to separate the product 28. Product 28 is separated into sets long before the loading process. This avoids the bottle neck of dual function separator bars. Separation does not slow down the later product loading process.

When 12-packs are being filled, a second bar 81 is mounted against each separator bar 76 to adjust spacing as shown on the right side of FIG. 2B. When 24-can cases are being filled, bars 81 are rendered.

Once separator bars 76 engage product 28 and divide the stream into sets of product 28, the separator bars 76 move product 28 along through guide deck 60 so that product 28 is no longer propelled merely by the force of successive product in the stream. Separator bars 76 move product 28 along guide deck 60 into second angled section 66 which diverges inwardly preferably at a 22° angle. Second and third product sensors 82 and 84 sense whether any product is missing or have fallen in guide deck 60. Product sensors 82 and 84 are constructed in the manner as product sensor 26, and are electrically connected to system controller in the same manner for signaling a product placement error.

A central conveyor 90 is the focus of loading operations. Control conveyor 90 has a first end at a point where guide deck 60 has diverged, so that central split loading conveyor 90, with mirror image like halves, comes up in the middle of package loader 10 between the two guide decks 60. The central loading conveyor 90 is moved by drive system 92 and like opposing chains 93 and carries carton flight bars 94. Flight bars 94 run along a central flight guide 95 and are illustrated having a fixed portion 96 and a removable portion 98. The spacing between flight bars 94 is adjusted by removing removable portion 98, such as for 24-can product operation, and replacing it with a different width portion. Alternatively, removable portion 98 may be left out, such as for 12-pack product packaging. Opposing finger members 99 extend vertically from the flight member 44 to assist a package carton along the central loading conveyor 40.

Central loading conveyor 90 is synchronized in timing with the separator bar conveyor 70. Carton flight bars 94 are positioned generally the same distance apart as separator bars 76, and are timed so that they match one-for-one with each said separator bar 76. The outboard end 100 of each flight bar 94 is shaped to generally mate with the angled end 80 of separator bar 76. The shape of end 100 is not important in that it does not engage product 28, but it should be shaped to generally mate with angled end 80 either by forming an angle or a step so that there is no large gap between flight bar 94 and separator bar 76.

Carton assembly section 16 illustrated in FIGS. 4A–4B includes a hopper 102 and a rotary placer 104. Here cartons are placed on the conveyor 90 between successive flight bars 94 and positioned across from adjacent separator bars 76 in oncoming product 28 in the lane area 68 for subsequent loading. Cartons are loaded into the hopper in horizontal position with the manufacturer's joint in the carton down and trailing. The cartons are urged into the hopper 102 by three powered belts. A vibrator on the incline hopper assists in feeding the cartons to the front of the hopper. Hold back clips hold the cartons in the pick position, while allowing clearance of the cartons as they are pulled from the hopper by vacuum cups on rotary placer 104.

Rotary placer 104 has four heads. Each rotary head has a vacuum cup shaft on which two vacuum cup stems are mounted. The rotary head is gear driven in a planetary motion around horizontal drive shaft. The horizontal drive shaft rotates 120° from the hopper to the placement position. During each revolution of the horizontal drive shaft, the vacuum cup shafts each rotate three times. When the vacuum cups contact the front carton in the hopper 102, the vacuum pressure in the cups attaches the carton to the cups. When the vacuum cups are rotated to the place position, the vacuum cup extends straight up and down and the carton is inserted between a pair of successive carton flight bars 94. At this place position, the vacuum cup is vented to atmosphere and the carton is released to be held by flight bars 94. At this point, the carton is in the open position where its cross section is rectangular, and is ready to receive product 28.

In operation, as central loading conveyor 90 is moving flight bars 94 down the center of package loader 10, product 28 is being moved down guide deck 60 by separator bars 76. Product 28 in the straight section 64 of guide deck 60 has diverged out of the center of package loader 10, and one of the flight bars 94 comes up from below the system on the central loading conveyor 90 and mates against the two opposing separator bars 76. From this point, the unified combination of flight bar 94 and the two opposing separator bars 76 moves together through product packing section 14 of package loader 10.

When each guide deck 60 begins to converge again towards the center of package loader 10 through second angled sections 66, product 28 follows the plurality of lane area 68 of guide deck 60 onto central loading conveyor 90. As angled section 66 nears central loading conveyor 90, product 28 is urged onto conveyor 90 by bars 76. A product 28 enters conveyor 90 it begins to be engaged by flight bars 94. As angled section 66 converges with conveyor 90, flight bars 76 loose contact with product stream 28 and return under the system back again to the beginning of separator bar conveyor 70. Once the opposing flight bars 76 are disengaged from the stream of product 28, product 28 is guided into centrally located cartons 106 as the angled sections 66 merge with central loading conveyor 90.

A set of parallel hold down bars 91*a*–91*b* secure to a plurality of pneumatically adjustable plates 93*a*–93*n*, suspend longitudinally over and above the top of carton 106, and extend to the area of the compression belts 116. A set of parallel opposing longitudinal upper flap guides 97*a*–97*b* hold the upper carton flaps in a horizontal or above horizontal position so that product can be loaded into the interior of the cartons 106.

This technique allows a rapid stream of transfer of product 28. For example, an embodiment loading 12 the present invention, is capable of loading 2,400 cans per minute. The smooth operation of externally intruding separator bars 76 and carton holding flight bars 94 allows for fast movement of product 28.

After leaving product packing section 14, the carton 106, filled with product 28, enters carton loading section 18. A can seating wheel 110 on either side of central loading conveyor 90 assist in final loading of the product 28 in the carton 106. There are cutouts or recesses on the can seating wheels 110 to clear the leading and trailing carton flaps during this sealing process, whereby the can seating wheels 110 contact product 28 without disturbing the flaps. Rotary tucker wheels 112 are mounted on vertical shafts to rotate relative to the central conveyor. The leading carton flap is plowed closed by a recess on the can seating wheel 110, and then the rotary tucker wheels 112 close the trailing flaps. Plows 101*a* and 101*b* hold both leading and trailing flaps closed as the carton 106 moves down stream.

Upper and lower flap plows 103*a*–103*b* and 105*a*–105*b* are positioned down stream of the rotary tucker wheels 112 to close the upper and lower flaps. Opposing plows 103*a*–103*b* firstly maneuver the bottom flaps upwardly, and secondly the opposing plows 105*a*–105*b* maneuver the top flaps downwardly over the bottom flaps. The mirror image can seating wheels 110 include a plurality of can seating cams 111*a*–111*n* for final positioning of the product cans within the carton 106 from both ends of the carton 106. A plurality of recesses 113*a*–113*n* and 114*a*–114*n* flanking the can seating cams 111*a*–111*n* serve to hold the dust flaps open and away from the sides of the carton ends so that the can seating cams 111*a*–111*n* may have unrestricted access to the carton ends. Recess closes the leading edge dust flap. Opposing rotary tucker wheels 112 turn five times the rate of the can seating wheels 110, and include a recess 115 for closure of the trailing edge flap. Compression belts 116 then engage the closed carton 106.

The compression belts 116 transfer cartons 106 to a plurality of discharge flights 118 mounted on outflow conveyor section 20. The discharge flights 118 include a plurality of like opposing vertically oriented finger members 119. The outflow conveyor section 20, including conveyor belts 20*a* and 20*b*, is an active conveyor which is moved by drive system 120 to move cartons 106 out of package loader 10. Like other flight bars in the package loader 10, discharge flights 118 are constructed of hard coated aluminum. The spacing between discharge flights 118 is adjustable in a similar fashion to carton flight bars 94. Only a small number of discharge, flights are illustrated for purposes of brevity and clarity of illustration.

Figure 10:
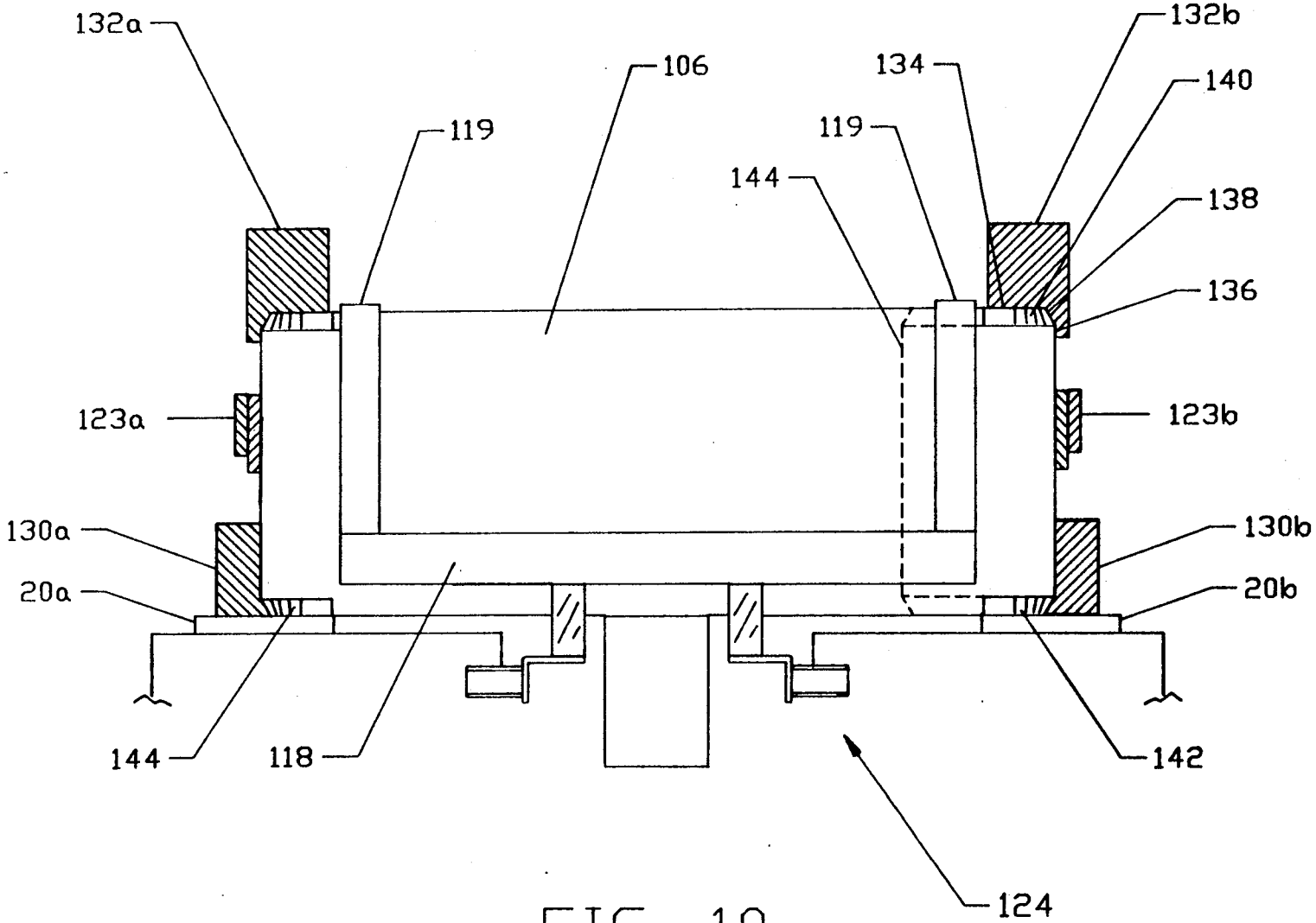

The conveyor belts 20*a* and 20*b* and discharge flights 118 carry the carton 106 containing product to the right so that opposing plows 107*a* and 107*b* engage and turn the upper flaps horizontal. Hot opposing Nordson glue systems 122*a* and 122*b* then apply hot glue to the lower flaps after which opposing plows 123*a*–123*b* position the upper flaps downwardly over the lower flaps. The lower portion of the carton 106 is also guided by opposing formed guide bars 130*a* and 130*b*. The upper portion of the carton 106 is guided by opposing formed upper guide bars 132*a* and 132*b*. The carton 106 engages the upper and lower guide bars 130*a*–130*b* and 132*a*–132*b* to form the carton upper and lower flaps about the beveled product can top and bottom edges, thus positioning the upper and lower flaps in their most advantageous position for tight packaging about the product as illustrated in FIG. 10.

Nordson glue systems 122*a*–122*b*, or other similar hot melt glue systems, are used to glue flaps on cartons 106 in a manner known in the prior art. A compression station 124 having opposing longitudinal compression members of which sides 125*a* and 125*b* are illustrated, is down stream from the glue systems 122*a* and 122*b* to compress the flaps on carton 106 to make sure the glue sets. In the preferred embodiment, compression station 124 is 6 feet long.

The apparatus constructed of the present invention greatly speeds up the product-loading techniques of the prior art. While the concept of converging product streams being loaded into a central carton is attempted in numerous prior art devices, none of them achieve the speeds and consistency of the present invention. The prior art techniques, where the central flight bar both separates cans into sets and holds the cartons, could not achieve these speeds. The prior art techniques of belt and finger methods to separate cans into sets are simply not fast enough or dependable enough to match today's speed requirements. By having a conveyor with separator bars merging into product stream from the outside and then having cartons held by separate flight bars in the central conveyor, dependability and speed can be achieved. Those skilled in the art may adapt the present invention to load any type of product which is suitable for conveyance by angled feed into containers.

Figure 3:
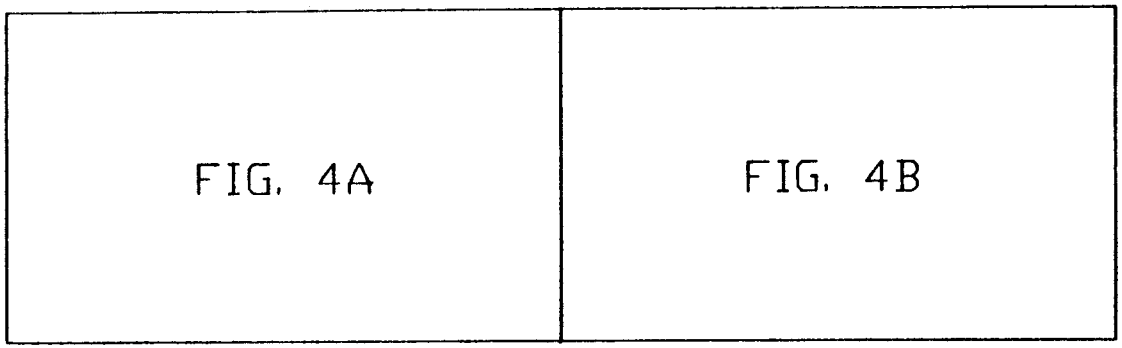
FIG. 3 illustrates the alignment of FIGS. 4A and 4B.

FIG. 3 illustrates the alignment of FIGS. 4A and 4B.

FIGS. 4A and 4B illustrate a side plan view of the package loader 10 of FIGS. 2A–2C where all numerals correspond to those elements previously described. Illustrated in particular is the hopper 102 and the rotary placer 104. A plurality of clear panels 126*a*–126*n* align about the upper portion of the package loader 10 above the bottom enclosure 128.

Figure 5:
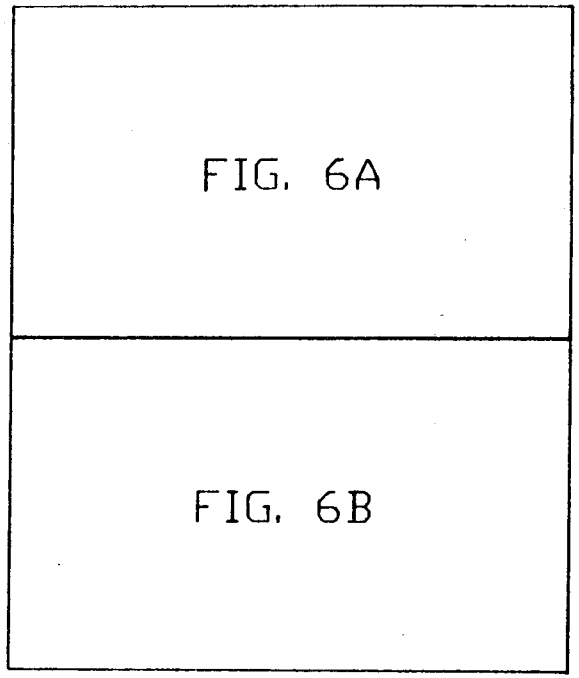
FIG. 5 illustrates the alignment of FIGS. 6A-6B.
Figure 6A:
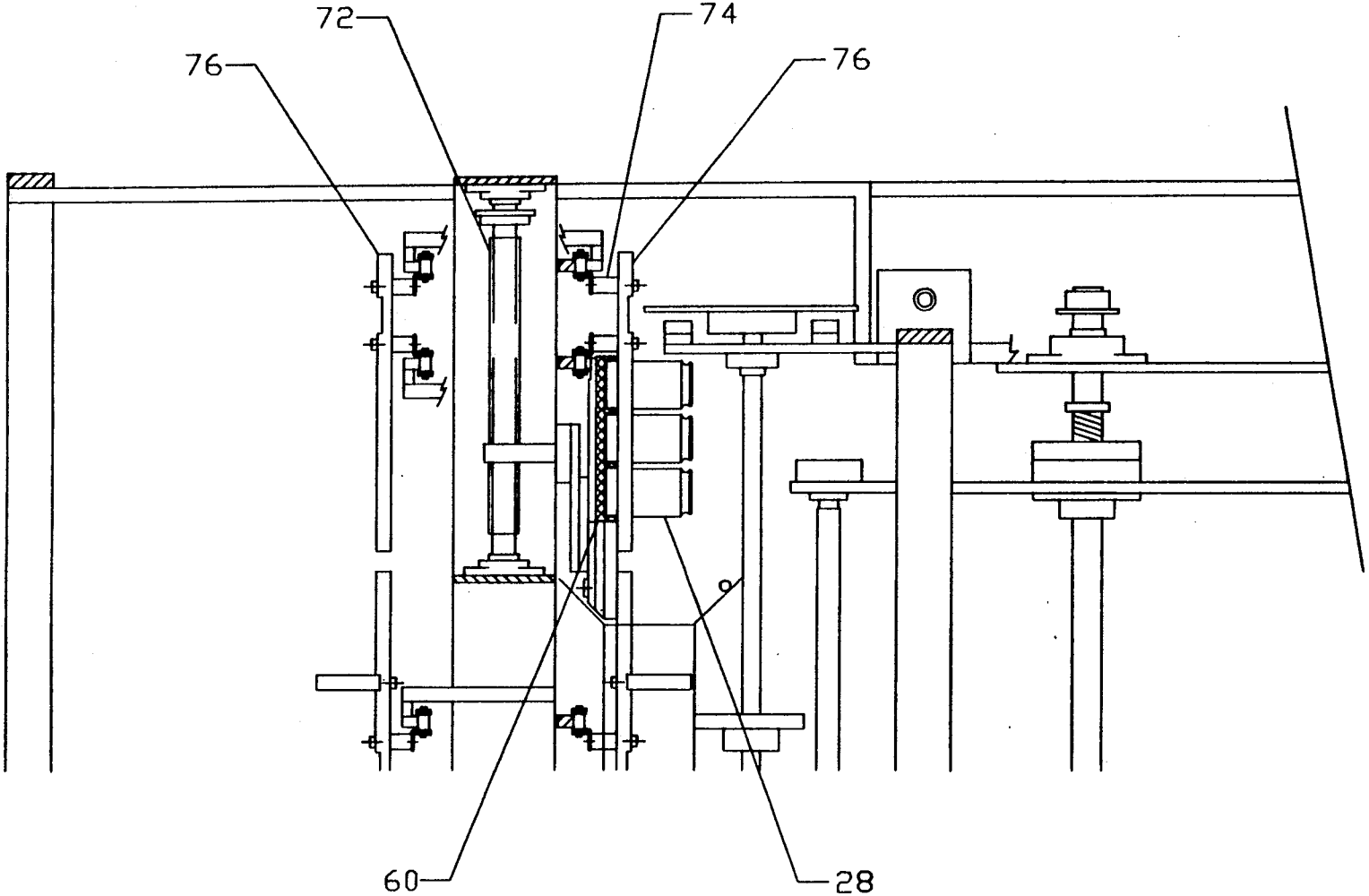
FIGS. 6A and 6B illustrate a cross-sectional view taken on lines 4—4 of FIGS. 2A-2C.
Figure 6B:
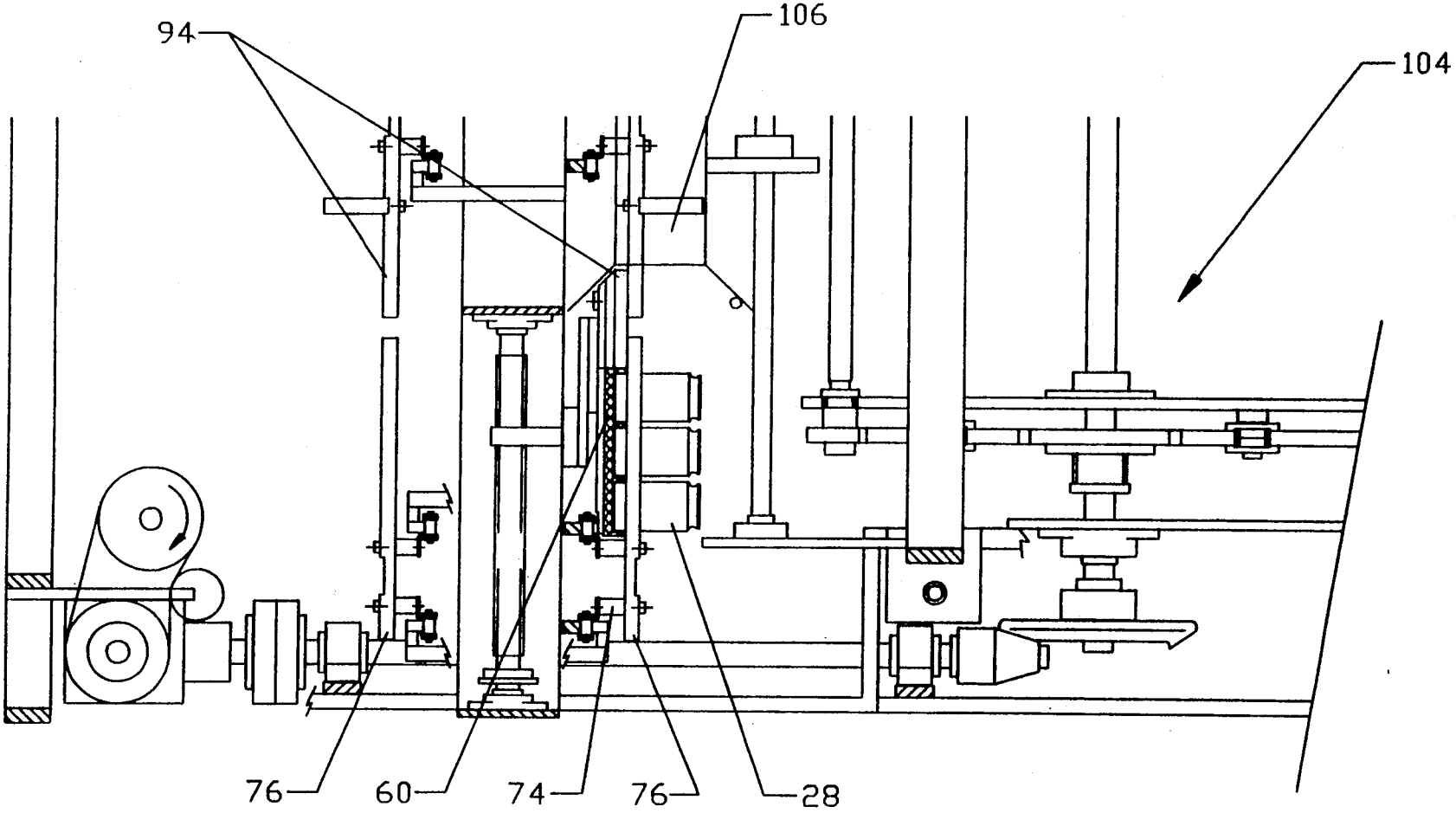

FIG. 5 illustrates the alignment of FIGS. 6A and 6B.

FIGS. 6A and 6B illustrate a cross-sectional view along line 6—6 of FIGS. 2A–2C where all numerals correspond to those elements previously described.

FIG. 7 illustrates a top view of the product sensor 26 where all numerals correspond to those elements previously described.

FIG. 8 illustrates a side view of the product sensor 26 where all numerals correspond to those elements previously described.

Figure 9:
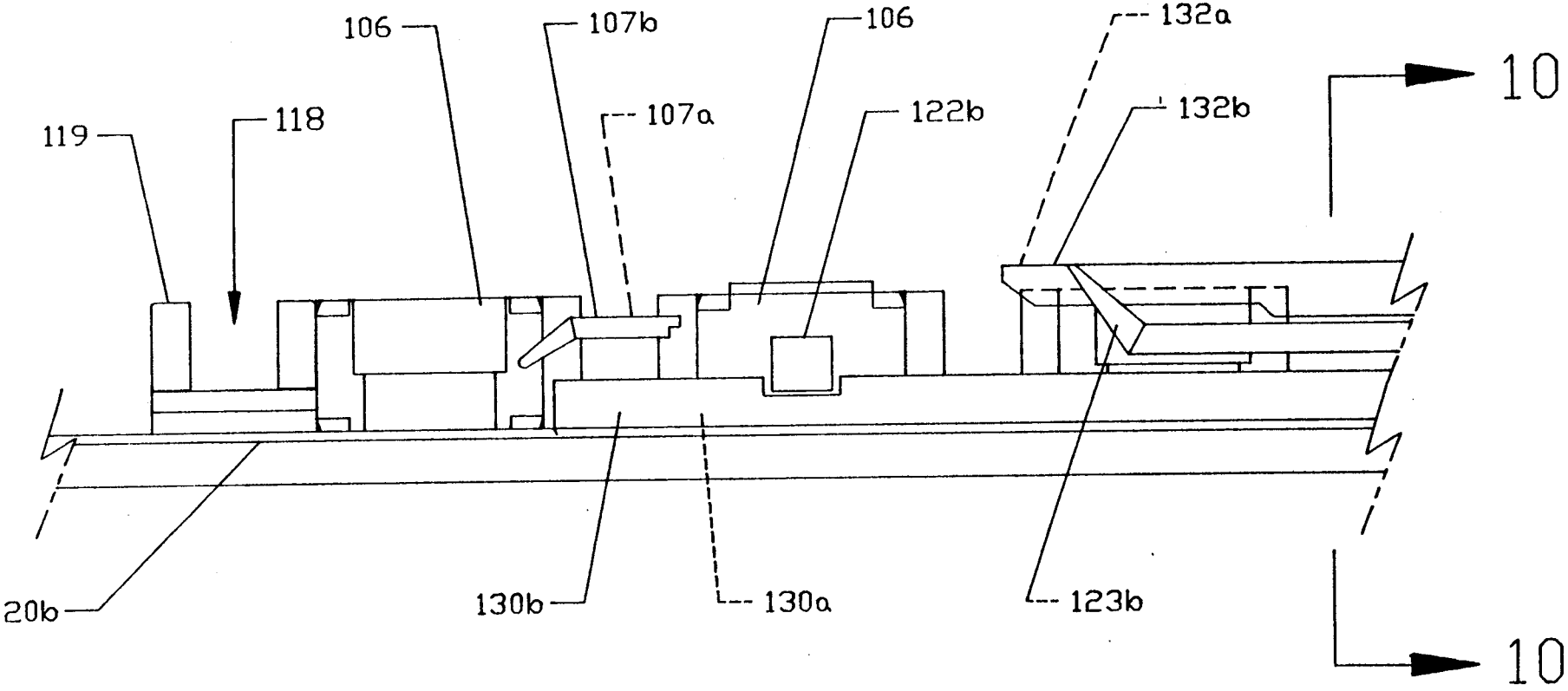
FIG. 9 illustrates a side view of the upper and lower formed guide bars; and, FIG. 10 illustrates a cross-sectional view of the upper and lower formed guide bars along line 10—10 of FIG. 9.

FIG. 9 illustrates a view along line 9—9 of FIG. 2C where all numerals correspond to those elements previously described. Illustrated in particular are the upper and lower formed guide bars 132*a*–132*b* and 130*a*–130*b*, respectively, which cause the major flaps of the carton 106 to be formed snugly over and about the beveled corner of the product cans as described in FIG. 10.

FIG. 10 illustrates a cross-sectional view of the formed guide bars 132*a*–132*b* and 130*a*–130*b* where all numerals correspond to those elements previously described. Each of the formed guide bars include vertical and horizontal surfaces joined by a chamfered surface. For purposes of example and illustration the upper formed guide bar 132*b* has a horizontal guide surface 134 and a vertical guide surface 136 with an interceding chamfered guide surface 138. Similar surfaces are also used in the other formed guides 132*a*, 130*a* and 130*b*. The beveled surface 138 of each formed guide bar insures that the flaps are held tight against the upper and lower beveled edges 140 and 142 of a product can 144 to provide a tight "wrap" about the product cans 144 in the carton 106. Holding the upper flap tight against the upper beveled can edge 140 allows the bottom edge of the upper flap to be positioned further down on the carton side. In a like manner holding the lower flap tight against the lower beveled can edge 142 allows the upper edge of the lower flap to be positioned further up on the carton side. Tight wrapping provides for a more secure package with improved integrity due to the fact that the product cans are more secure and less apt to cause carton or product damage as caused by shifting contents of loosely packaged items which can self-destruct from the inside out.

MODE OF OPERATION

Appendix 1 is incorporated herein by reference as to the operation of the packaging system for packing patterns of cans into a cardboard carton, whereupon cans are firmly positioned with respect to each other and the flaps are forced together and glued as illustrated in FIG. 10. This packaging system operates at high packaging speed and provides a secure positioning of all the cans with respect to each other in the carton as illustrated in FIG. 10.

Various modifications can be made to the present invention without departing from the apparent scope hereof.

| | |
|---|---|
| 10 | package loader |
| 12 | in-feed section |
| 14 | product packaging section |
| 16 | carton assembly section |
| 18 | carton gluing section |
| 20 | outflow conveyor section |
| 20a–b | conveyor belts |
| 22 | in-feed conveyor |
| 24 | drive system |
| 26 | product sensor |
| 28 | product |
| 30a–n | guide rails |
| 32 | supports |
| 34 | threaded rod |
| 36 | side member |
| 38 | side member |

-continued

| | |
|---|---|
| 40 | side support |
| 42 | rod |
| 44 | fingers |
| 46 | photo-eye transmitter |
| 47 | photo-eye receiver |
| 48 | sensor |
| 50 | angle |
| 60 | guide deck |
| 62 | first angled section |
| 64 | straight section |
| 66 | second angled section |
| 68 | lane area |
| 70 | separator bar conveyors |
| 72 | drive system |
| 73 | shaft |
| 74 | bar mounts |
| 75 | shaft |
| 76 | separator bars |
| 78 | chains |
| 80 | angled end |
| 81 | separator bar |
| 82 | product sensor |
| 84 | product sensor |
| 90 | central loading conveyor |
| 91a–b | hold down bars |
| 92 | drive system |
| 93 | chains |
| 93a–n | plates |
| 94 | carton flight bars |
| 95 | central flight guide |
| 96 | fixed portion |
| 97a–b | upper flap guides |
| 98 | removable portion |
| 99 | fingers |
| 100 | end |
| 101a–b | plows |
| 102 | hopper |
| 103a–b | plows |
| 104 | rotary placer |
| 105a–b | plows |
| 106 | carton |
| 107a–b | plows |
| 110 | can seating wheel |
| 111a–n | can seating cams |
| 112 | rotary tucker wheel |
| 113a–n | recesses |
| 114a–n | recesses |
| 115 | recess |
| 116 | compression belts |
| 118 | discharge flights |
| 119 | finger members |
| 120 | drive system |
| 122a–b | Nordson gluing system |
| 123a–b | plows |
| 124 | compression station |
| 124a–b | compression station members |
| 125 | longitudinal compression member |
| 126a–n | clear panels |
| 128 | bottom enclosure |
| 130a–b | lower formed guide bars |
| 132a–b | upper formed guide bars |
| 134 | horizontal guide surface |
| 136 | vertical guide surface |
| 138 | chamfered guide surface |
| 140 | beveled can edge |
| 142 | beveled can edge |
| 144 | product can |

We claim:

1. A packaging system for inserting product containers into cartons comprising:

a. carton conveyor for conveying cartons to be filled with product in a first direction;

b. a product conveyor having an in-feed portion parallel to the first direction, an outwardly angled portion at a diverging angle from the first direction, and an inwardly angled portion at a converging angle to the first direction downstream of the outwardly angled portion;

c. a separator bar conveyor mounted generally parallel to the in-feed portion of the product conveyor for movement in the first direction, having a first end upstream of the outwardly angled portion and a second end downstream of the inwardly angled portion; and, d. separator bars mounted on the separator bar conveyor fixed against lateral movement relative to the carton conveyor, and spaced apart for separating sets of product, the separator bars mounted for entering the stream of product as product follows the outwardly angled portion and for leaving the stream as product follows the inwardly angled portion.

2. The packaging system of claim 1 further comprising carton flight bars mounted on the carton conveyor for separating and moving cartons, the carton conveyor having a first end downstream of the outwardly angled portion and wherein the inwardly angled portion merges against the carton conveyor for merging product into cartons.

* * * * *